United States Patent [19]

Sanders

[11] Patent Number: 4,565,123

[45] Date of Patent: Jan. 21, 1986

[54] TENSION CONTROL FOR BALING MACHINE

[76] Inventor: Gerald W. Sanders, 650 Beckley Ave., Marion, Ohio 43302

[21] Appl. No.: 609,029

[22] Filed: May 10, 1984

[51] Int. Cl.[4] ..... B30B 15/26

[52] U.S. Cl. ..... 100/43; 100/50; 100/192

[58] Field of Search ..... 100/43, 48, 50, 53, 100/191, 192

[56] References Cited

U.S. PATENT DOCUMENTS

| | | | |
|---|---|---|---|
| 2,722,884 | 11/1955 | Seltzer | 100/192 |
| 3,179,040 | 4/1965 | Seltzer | 100/43 |
| 3,789,752 | 2/1974 | Wirz | 100/43 |
| 4,413,554 | 11/1983 | Wallander | 100/43 |

FOREIGN PATENT DOCUMENTS

| | | | |
|---|---|---|---|
| 2026301 | 12/1971 | Fed. Rep. of Germany | 100/192 |

*Primary Examiner*—Peter Feldman

*Attorney, Agent, or Firm*—Pearne, Gordon, Sessions, McCoy, Granger & Tilberry

[57] ABSTRACT

A tension control system for a baling machine has a pressure switch connected to the high pressure fluid supply. The switch is operable to actuate when the pressure of the fluid supply exceeds a predetermined level, such as when the baling head ram cylinder is approaching a stalled condition. A solenoid controlled valve is located between the high pressure fluid supply and the fluid cylinder which operates the tension mechanism on the throat portion of the baling machine. The solenoid is operatively connected to the pressure switch to close when the pressure of the fluid supply exceeds to predetermined level. When the valve closes, fluid pressure in the tension cylinder is relieved so that the cylinder operating the baling head does not become stalled. When the baling head is again capable of operation, the pressure switch deactuates, returning the valve to an open condition so that tension is restored to the throat portion of the baling machine.

10 Claims, 2 Drawing Figures

TENSION CONTROL FOR BALING MACHINE

BACKGROUND OF THE INVENTION

1. Field of the Invention

This invention relates to machines for compacting and forming bales of material in a continuous extrusion type baling machine, and in particular to tensioning means for holding the previously formed bale in the throat portion of the machine.

2. Description of the Prior Art

Baling machines for baling waste paper and other industrial refuse are known and are generally used for the purpose of forming the material into bales which can be easily handled while they are being transported to a place where the material is to be reprocessed. Such baling machines conventionally comprise a horizontal baling chamber having sides for constraining the bale laterally and an open outlet end of controllable cross section from which the bales are extruded, and a feed hopper inlet opening into the top side of the baling chamber for delivering material to form the bale. A baling head reciprocates in the baling chamber past the inlet opening between a rearward position of retraction and an advanced position of extension. The baling head is conventionally driven by a fluid cylinder, specifically a hydraulic cylinder. In operation, a charge of compressable material is dumped into the hopper and drops into the baling chamber while the baling head is retracted. Successive charges are compressed and compacted together in the baling chamber against the resistance of the material previously compressed and being extruded through the throat by repeated strokes of the baling head. In this manner a length of compacted and compressed material is formed and extruded through and out the outlet open end of the baling chamber.

The baling chamber is typically provided with an orifice portion of minimum cross-sectional area or a throat which can be varied by a tension mechanism driven by fluid or hydraulic power derived from the same hydraulic system powering the compression and extrusion baling head. The throat size varies the resistance to the outflow of compressed material from and through the baling chamber. As this tension or resistance to outflow increases, the hydraulic pressure in the cylinder driving the baling head must increase. If the resistance becomes too great, the machine stalls. The intended operation is interrupted, excessive heat is developed, and power is wasted.

Such a machine, together with the material to be baled passing through the machine, thus represents a hydraulic-mechanical closed loop system. The hydraulic cylinder operating the baling head and the actuated tension mechanism controlling the orifice and resistance to the flow through the baling chamber are interconnected on the one hand through the main hydraulic system and on the other hand through a mechanical path comprising the baling head, the movable orifice-defining walls of the baling chamber and the compressed material between them.

It is desirable and efficient to operate such machines near the maximum pressure that can be safely developed by the hydraulic system. Maximum pressure produces compressed or extruded bales of the greatest possible density. Efficient operation also requires that the machine not be operated into a stalled condition.

One way to prevent stalling is to use pressure relief valves in the main hydraulic system. Such relief valves are effective to prevent stalling but greatly reduce the efficiency of the machine's operation. For example, the pressure rise in the hydraulic cylinder operating the baling head is generally hyperbolic. The very sudden and steep rise in pressure experienced just prior to stalling requires main-system type relief valves to be set well below maximum deliverable system pressure if the system is to be adequately protected. This represents wasted pump capacity. Additionally, such relief valves act to dump main system pressure which must be reestablished before operation can be resumed. Time and power are wasted. Because of the excessive pressure developed in the hydraulic cylinder operating the baling head is not dealt with and still must, of course, be removed or the load relieved in some manner before beginnning operation again.

Another way to prevent stalling is to dump the main system pressure and the pressure from the cylinder operating orifice-controlling tension mechanism of the machine. This is typically accomplished by an unloading valve inserted in a line branching off to a tank from a line connecting the hydraulic tension cylinder to the main system. This system also suffers from the disadvantage of permitting main system pressure and fluid to be lost to the pressure side of the system. Also, to the extent that the main system fluid is lost through such an unloading valve, fluid from the tension cylinder is prevented from being unloaded and the problem and its solution is thereby prolonged at the expense of efficiency.

U.S. Pat. No. 3,467,000 describes a control system for a hydraulically-operated orifice-controlling tension cylinder which includes a pilot-operated check valve connected to the cylinder. The flow of fluid to the tension cylinder through the check valve is controlled by a second valve which is movable between a first position in which supply pressure is supplied to the tension cylinder through the check valve and a second position in which supply pressure is supplied to the pilot pressure port of the check valve to cut off the flow of fluid to the tension cylinder. The second valve is operated by a second pilot line connected to the supply pressure so that the valve changes position when the pressure supply in the conduit exceeds a predetermined level. This system prevents stalling of the machine by timely relieving the excessive resistance load responsible for the impending stall. It also restores the machine to its normal operating condition after relieving the excessive load.

The control system described in the aforementioned U.S. Pat. No. 3,467,000 however, requires the use of a specialized relief valve which is relatively expensive to fabricate. In addition, this control system will only accept a supply pressure up to a set pressure of about 1,000 psi. The control system must include means for reducing the supply pressure above this set pressure to assure that the pressure supplied to the tension cylinder is at or below 1,000 psi. Up to 1,800 psi, the supply pressure is received and reduced by this pressure reducing means. In the event that the supply pressure exceeds 1,800 psi, the control system must include means for fully relieving all pressure. This pressure relief means dumps the system pressure to zero and opens the tension cylinder to relieve pressure on the bale on the throat portion. Thus the control system includes many of the disadvantages of the aforementioned control systems in that system pressures may be undesirably dumped.

Other control systems for maintaining proper tension on the extrusion throat of the baling machine are shown in U.S. Pat. Nos. 3,350,999, issued to Morse; 4,059,049, issued to Tillgren; 4,168,659, issued to Yatcilla et al.

SUMMARY OF THE INVENTION

The present invention overcomes the disadvantages of the prior art control systems and provides further advantages heretofore not obtainable. The present invention provides a control device for use with a hydraulically operated extrusion press, having a hydraulically controllable outlet resistance orifice and of the closed-loop type described above, which permits the press to be operated in a highly efficient manner at or near fully capacity without stalling or similar interruption of the machine's operation. The invention provides a hydraulic anti-stall control device for an extrusion press which prevents stalling by timely relieving of the excessive resistance load responsible for the impending stall. The invention also provides a device which restores the machine to its normal operating condition after the relieving the excessive load.

The present invention provides for the control of machines such as those described above in which bales are produced of a uniform density while achieving the desirable anti-stall characteristics. The invention disclosed, therefore, comprehends means for controlling the outlet orifice in accordance with a constant tensioning or compressing control principle to provide uniform density bales.

The present invention also eliminates the need for especially designed and manufactured valving assemblies which must be fabricated with close tolerances in order to operate efficiently. The present invention can achieve the desired results using conventional hydraulic and electrical components without the need for expecially manufactured and designed valving components. The present invention also eliminates the need for pressure relief valves to protect such special valving components for excessive system pressures.

The result is a positive-action, reliable, trouble-free, and relatively economical improved hydraulic control device for controlling the operation of a baling machine permitting all of the advantages, such as maximum pressure operation and constant bale tensioning control while overcoming the disadvantages of the prior art.

These and other advantages are achieved by the present invention of an improved tension control system for use in combination with a baling machine. The baling machine has a baling chamber with a discharge outlet. There is a throat portion adjacent to the discharge outlet of the baling chamber into which compacted bales are forced. A reciprocal baling head is movable within the baling chamber to compact material charged into the chamber against the rear surface of a previously compacted bale. Tension means associated with the throat portion of the baling means are adapted to hold the previously compacted bale in position in the discharge outlet of the baling chamber until a predetermined force is applied to the bale. The tension means is operated by a fluid cylinder connected to the throat portion. There is a supply of pressurized fluid connected to the tension means. A pressure switch is connected to the fluid supply. The switch is operable to actuate when the pressure of the fluid supply exceeds a predetermined level. A valve is located between the cylinder and the fluid supply. The valve is operatively connected to the pressure switch to close when the pressure of the fluid supply exceeds the predetermined level.

DETAILED DESCRIPTION OF A PREFERRED EMBODIMENT

Figure 1:
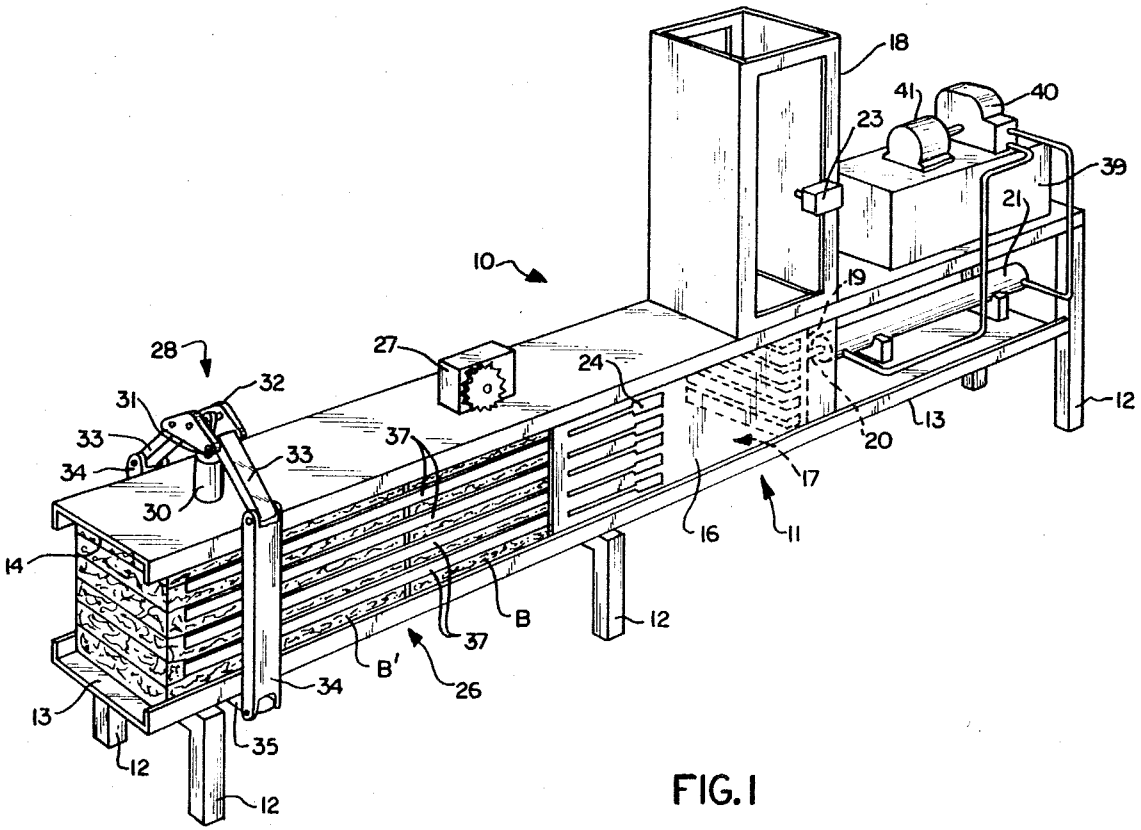
FIG. 1 is a perspective view of a conventional baling machine with which the control of the present invention is used.

Referring more particularly to the drawings and initially to FIG. 1, there is shown a baling machine 10 with which the tension control system of the present invention is used. The baling machine 10 has a support frame 11 which includes a plurality of leg portions 12 and a longitudinally extending floor 13. Extending parallel to and spaced above the floor 13 is an upper side 14.

Along a portion of the baling machine 10, the floor 13 and the upper side 14 are connected by enclosing sides 16 to form a baling chamber 17. At the rearward end of the baling chamber 17, the top of the baling chamber is open and communicates with a feed hopper 18. Within the baling chamber 17, there is a baling head 19 reciprocated by a ram means comprising a rod 20 extending from a hydraulic cylinder 21.

In the normal operation of the baling machine 10, the material to be baled is deposited in the feed hopper 18 with the baling head 19 in its retracted position. When the level of the material in the baling chamber 17 and the feed hopper 18 reaches a predetermined height, this height is sensed by a photocell control unit 23 located on the feed hopper 18. The charge of material in the baling chamber 17 is then compressed by reciprocation of the baling head 19 into a pad or wafer of compressed material. After a number of charges have been compressed together and a sufficient number of pads or wafers have accumulated to form the desired the length of a full bale, the baling head 19 is moved to its fully advanced and tying position, and a plurality of wires are inserted manually or automatically (by apparatus not shown in the drawings) through openings 24 in the side 16 of the baling chamber 17 and through corresponding traverse passages in the baling head 19. After these wires have been tied, formation of another bale begins in the baling chamber 17, and the finished bale is forced through a throat portion 26 of the baling machine, in a manner such as that of bales B and B' in FIG. 1. The throat portion 26 at the output end of the baling chamber 17 comprises the top wall 17 and a plurality of movable side wall portions 37. The side wall portions 37 are fixedly mounted near the baling chamber 17 while their opposite ends are able to be moved toward and away from each other and held at varying position therebetween so as to form a variably tapered construction for outlet passage having a minimum lateral dimension somewhat less than that of the baling chamber. As each bale is being formed in the baling chamber 17, the desired length of the bale, as indicated by the movement of the last finished bale B in the throat portion 26, is measured by a conventional bale length measuring wheel 27.

Resistance to the movement of the bales in the throat portion 26 is provided by a toggle-like constricting mechanism 28. The mechanism 28 acts to constrict the space between the free ends of the movable side wall portions 37 and between the floor 13 and the upper side 14 in the throat portion 26 of the baling machine. This resistance of the throat portion 26 to the movement of the bales through allows the end of the last finished bale B to provide a firm wall against which the material in the baling chamber 17 is compacted by the baling head 19. The mechanism 28 includes a tension cylinder 30 having an upwardly extending rod 31. The top of the rod 31 is attached to top member 32. The top member 32 joins together the two toggle members 33, each of which is attached to the top of the side member 34. The side members 34 hold the free ends of the movable side wall portions 37. The lower ends of the two side members 34 are attached together by a bottom member 35 which extends beneath the floor 13 of the throat portion 26.

As fluid is supplied to the tension cylinder 30, the rod 31 is forced upwardly moving the top member 32 of the mechanism 28 with it. At the same time, the upper side 14 of the throat portion 26 is forced downwardly by the pressure applied by the cylinder 30. As the top member 32 moves upwardly it pulls the bottom member 35 upwardly through its connection with the toggle members 33 and the side members 34. The bottom member 35 thus pulls the floor 13 of the throat portion 26 upwardly with respect to the upper side 14. The side members 34 are pulled toward each other to urge the free ends of the movable side wall portion 37 inwardly. As a result, the sidewall portions 37 are moved together and the floor 13 and the upper side 14 are moved together in the area of the mechanism 28 as fluid is applied to the cylinder 30. The force which is applied between the sidewall portions 37 and between the floor 13 and the upper side 14 corresponds to the fluid pressure supplied to the cylinder 30. As a greater fluid is supplied to the cylinder 30, the tension force applied to the bale B' at the area of the mechanism 28 increases. This force, which holds the bale B' in place in the throat portion 26 can only be overcome by the force of the baling head 19 as it forces the next bale through the throat portion 26 of the baling machine. In this manner, high density bales are produced.

The baling ram cylinder 21 and the tension cylinder 30 are both supplied with hydraulic fluid from a tank forming a supply reservoir 39. A pump 40 driven by a motor 41 supplies high pressure fluid from the reservoir 39 to the cylinders 21 and 30.

Figure 2:
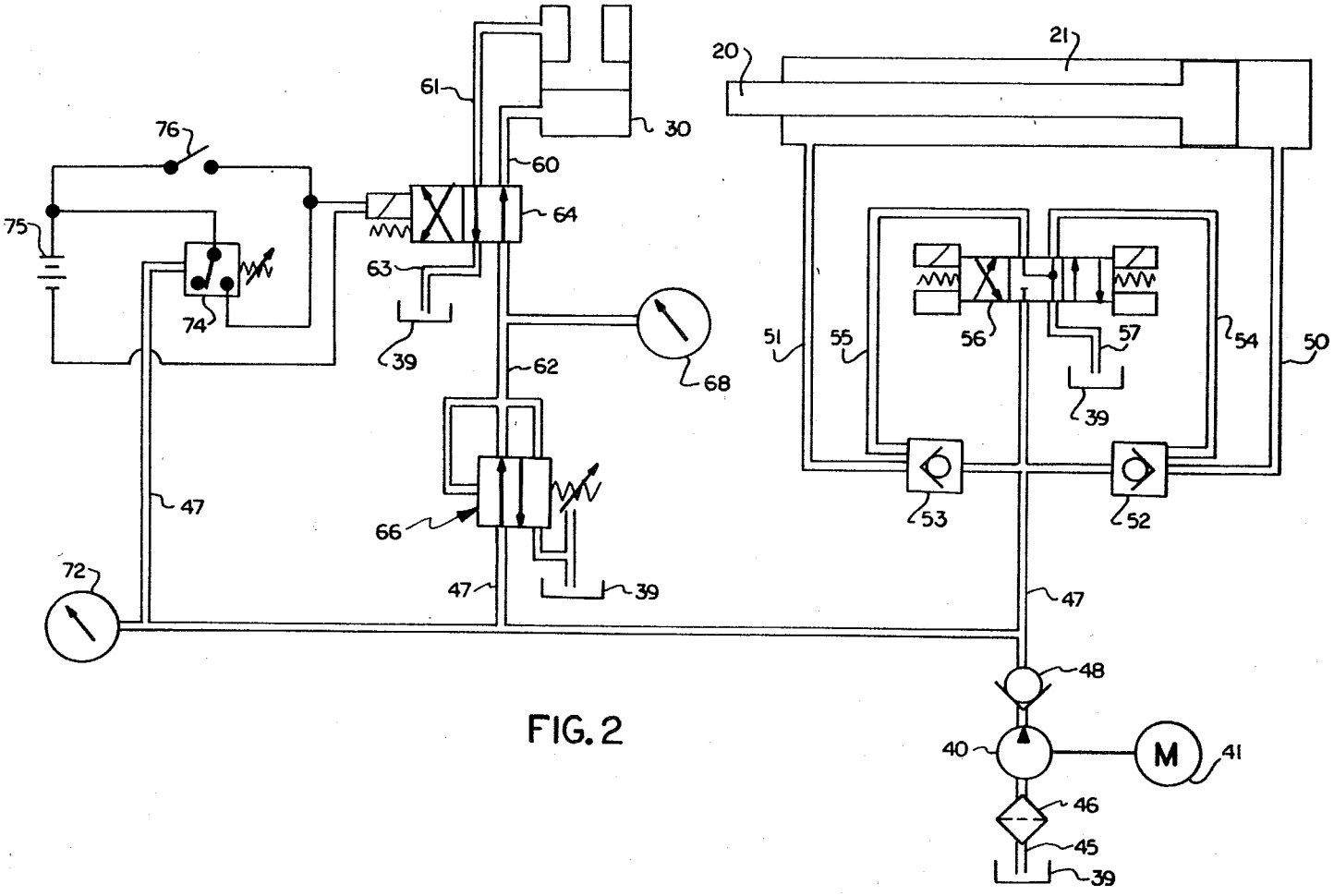
FIG. 2 is a schematic diagram employing conventional fluid power graphic symbols showing the hydraulic control system of the present invention.

The hydraulic system of the present invention can be seen in greater detail with reference to FIG. 2. The hydraulic system comprises the pump 40 driven by a suitable source of power, such as the motor 41, and having a low pressure inlet conduit 45 connected to the reservoir 39. A suitable filter/strainer 46 can be supplied in the conduit 45. The pump 40 also has a high-pressure outlet supply conduit 47 which supplies high pressure fluid to the system. A check valve 48 may be provided at the high pressure outlet of the pump 40 to prevent back flow through the pump.

The baling head ram cylinder 21 is supplied with high pressure fluid through a pair of conduits 50 and 51. The conduit 50 supplies high pressure fluid behind the piston in the cylinder 21 to advance the rod 20. The conduit 51 supplies high pressure fluid in front of the piston of the cylinder 21 to retract the rod 20. The supply of high pressure fluid from the supply conduit 47 to the conduits 50 and 51 is controlled by a pair of opposed pilot-operated check valves 52 and 53. The pilot-operated check valve 52 is provided between the supply conduit 47 and the conduit 50. The pilot-operated check valve 53 is located between the supply conduit 47 and the conduit 51. The check valves 52 and 53 are operated by the flow of high pressure fluid in control conduits 54 and 55. The control conduits 54 and 55 are connected to a four-way valve 56. The valve 56 may be operated by solenoids connected to suitable electrical controls for control of the movement of the baling head or the valve 56 may be operated manually in the event that the electrical control is unsuitable or not functioning. The valve 56 is spring centered so that both control conduits 54 and 55 are normally connected to a relief conduit 57 which is diagrammatically connected to the reservoir 39. The valve 56 is also connected to a conduit 58 which is connected directly to the supply conduit 47 so that high pressure fluid may be selectively supplied to either the conduit 54 or the conduit 55 by actuation of the valve 56.

When the valve 56 is actuated to move it to the right as shown in FIG. 2, the control conduit 54 is connected to the supply of high pressure fluid from the conduit 58. The high pressure fluid in the control conduit 54 applied to the pilot port of the check valve 52 operates to open the valve 52 so that high pressure fluid is supplied through the conduit 50 to the chamber behind the piston of the cylinder 21 to advance the rod 20 and thus to advance the baling head 19. When the valve 56 is actuated to move it to the left as shown in FIG. 2, the control line 55 is connected to the supply of high pressure fluid from the conduit 58 while the control line 54 is connected to the relief conduit 57. The supply of high pressure fluid to the pilot port of the check valve 53 opens the valve to supply high pressure fluid through the conduit 51 to the chamber in front of the piston of the cylinder 21 to retract the rod and to retract the baling head.

The hydraulic fluid is supplied to the tension cylinder 30 by a pair of conduits 60 and 61. The conduit 60 supplies fluid behind the piston of the cylinder 30 to advance the rod 31 and apply tension to the throat portion 26 of the baling machine. The conduit 61 supplies fluid in front of the piston of the cylinder 30 to retract the rod 31 and relieve tension on the throat portion 26. The conduits 60 and 61 are connected to an intermediate supply conduit 62 and a relief conduit 63 through a four-way single solenoid-operated valve 64. With the valve 64 in its neutral position, the conduit 60 is connected to the intermediate supply conduit 62, and the conduit 61 is connected to the relief conduit 63. The relief conduit 63 is connected to the supply side of the hydraulic system as shown diagrammatically by its connection to the reservoir 39. With the valve 64 in its neutral position, intermediate pressure fluid in the conduit 62 is supplied through the conduit 60 to the chamber behind the piston of the cylinder 30 to advance the rod 31 and apply tension to the throat portion 26 of the baling machine. The chamber in front of the piston of the cylinder 30 is relieved of pressure through the connection of the conduit 61 to the relief conduit 63. When the valve 64 is actuated by the solenoid, it moves to the right as shown in FIG. 2 and the supply of intermediate pressure fluid in the conduit 62 is connected to the conduit 61 to retract the piston rod 31, while the chamber behind the piston is relieved of pressure through the connection of the conduit 60 with the relief conduit 63.

Intermediate pressure fluid is supplied in the conduit 62. The pressure of the fluid in the conduit 62 is normally somewhat less than that of the high pressure fluid supplied in the supply conduit 47. A pressure reducing valve 66 is provided between the high pressure supply conduit 47 and the intermediate pressure supply conduit 62. The pressure reducing valve 66 can be variably set. Typically, the pump 40 supplies high pressure fluid in the supply conduit 47 at a system pressure of approximately 2,100 psi. The pressure reducing valve 66 is typically set at 1,000 psi, so that if the valve 66 operates properly, fluid is supplied in the intermediate supply conduit 62 at a pressure of 1,000 psi. A gauge 68 may be connected to the intermediate supply conduit 62 to measure the intermediate pressure in this conduit. A gauge 72 may also be connected to the high pressure supply conduit 47 to provide a monitor of the system pressure.

The solenoid of the four-way valve 64 is controlled by electrical connection to a pressure switch 74. The pressure switch 74 has a variable setting and may be set at any desired pressure. Typically, the pressure switch 74 may be set at about 1,800 psi. When the pressure in the supply conduit 47 exceeds the setting of the pressure switch 74, the switch closes to actuate the solenoid of the valve 64. The valve 64 actuates, moving to the right as shown in FIG. 2, to retract the rod 31 and relieve tension to the throat portion 26 of the baling machine. The electrical circuit connecting a voltage supply 75 to the solenoid of the valve 64 also includes a manually operated bypass switch 76. The switch 76 may be manually operated to actuate the valve 64 to relieve tension in the throat portion 26 of the baling machine, such as is necessary in ordinary maintenance of the machine.

In operation of the hydraulic system of FIG. 2, the baling operation is initiated by actuating the valve 56, moving it to the right as shown in FIG. 2, so that high pressure fluid is supplied behind the piston of the cylinder 21 to advance the baling head 19. The valve 64 is in its neutral position as shown in FIG. 2, so that intermediate pressure fluid is supplied behind the piston of the cylinder 31 and tension is applied to the throat portion of the baling machine so that previously formed bales are securely held in the throat portion to form a surface against which the new bale is formed. As additional charges of material are added to the baling chamber 17, the valve 56 is actuated back and forth to advance and retract the baling head.

In the event that the machine approaches a stalled condition, the valve 56 would be in its actuated position as shown moved to the right in FIG. 2, so that high pressure fluid is being supplied from the supply conduit 47 through the conduit 50 to the chamber behind the piston of the cylinder 21. The pressure reducing valve 66 operates to supply intermediate pressure fluid through the conduit 62. With the valve 64 in its neutral position as shown in FIG. 2, this intermediate pressure fluid is then supplied through the conduit 60 to the chamber behind the piston of the cylinder 30. If the baling head 19 begins to approach a stalled condition, it will encounter resistance and pressure behind the piston in the cylinder 21 will begin to increase. The pump 40 will continue to operate to increase the pressure of the fluid. However, the pressure will not be used to advance the piston rod 20 due to the resistance encountered by the baling head and the system pressure in the supply conduit 47 will continue to increase. As this pressure approaches a stalled condition, the pressure switch 74 will actuate. Actuation of the switch 74 will actuate the solenoid of the valve 64 to actuate the valve so that it moves to the right as shown in FIG. 2. When the valve 64 is actuated, the chamber behind the piston in the cylinder 30 will be connected through the conduit 60 to the relief conduit 63 and intermediate pressure fluid in the conduit 62 will be supplied through the conduit 61 to the chamber in front of the piston in the cylinder 30. The rod 31 will retract relieving tension in the throat portion 26 of the baling machine. This relief of tension in the throat portion 26 will enable the baling head 19 to begin to move forward again. As the baling head begins to move forward, the chamber behind the piston in the cylinder 21 increases in volume and additional fluid is supplied to the chamber through the conduit 50 from the supply conduit 47. This permits the system pressure in the supply conduit 47 to decrease somewhat. As the system pressure in the supply conduit 47 decreases, the pressure switch 74 deactuates so that the solenoid of the valve 64 deactuates the valve 64, moving it to its neutral position as shown in FIG. 1. The intermedate pressure fluid from the conduit 62 is again supplied through the conduit 60 to the chamber behind the piston in the cylinder 30 and the chamber in front of the piston is again connected to the relief conduit 63 through the conduit 61. Normal operation of the hydraulic system can continue again until such time as the baling head approaches a stalled condition, at which time the system will again operate as before to obviate the stall.

The hydraulic system thus disconnects the intermediate pressure fluid supply to the tension cylinder when the main system pressure exceeds a predetermined level as when increased by excessive resistance to the flow of material to the baling machine throat portion. The system automatically relieves the pressure in the tension cylinder when this occurs. Because of the closed loop nature of the baling machine system, a hydraulic pressure developed in the main hydraulic system as a result of excessive resistance encountered in the throat of the baling chamber is reduced when pressure in the tension cylinder is relieved.

Thus the invention is able to achieve certain advantageous results in the operation of closed loop systems involving a hydraulic link, specifically in a baling machine as described above. Its operation is automatic. The source of unregulated main system pressure can be safely permitted to rise to a predetermined maximum level, at which time, the control system responds positively to limit the main system pressure to the predetermined maximum level. The control system limits and relieves excess main system pressure only by relieving the workload of the system. The control system does not limit main system pressure by direct relief of pressure in the main system alone or even together with system load relief. Specifically, the control system limits the hydraulic pressure in the main system by passing to reservoir only fluid which has been relieved from the front of the piston of the tension cylinder 30. No fluid from any other part of the hydraulic system is dumped or directed to the reservoir by the control system. Operation is continued without a stall and without wasting time and power to rebuild lost main system pressures. Only a minimal amount of fluid is dumped to the return side of the system from the tension cylinder controlling the size of the variable orifice or throat of the baling chamber. This particular tension cylinder preferably has a short stroke and is linked to the orifice structure in a manner which permits substantial variation in orifice size to be accomplished by adding or taking small amounts of fluid to or from the actuator cylinder. This is normally accomplished using the convential toggle-like mechanism 28. Thus, the desired control function is achieved with a minimum loss of power and of time and with high efficiency.

It will be obvious to those skilled in the art to which this invention pertains that various modifications and changes of the preferred embodiment described and shown herein may be made without departing from the spirit and scope of this invention.

What is claimed is:

1. In combination with a baling machine having a baling chamber with a discharge outlet, a throat portion adjacent to the discharge outlet of the baling chamber into which compacted bales are forced, a reciprocal baling head movable within the baling chamber to compact material charged into the chamber against the rear surface of a previously compacted bale, a first fluid cylinder for reciprocating the baling head, tension means associated with the throat portion of the baling machine adapted to hold the previously compacted bale in position in the discharge outlet of the baling chamber until a predetermined force is applied to the bale, the tension means being operated by a second fluid cylinder connected to the throat portion, there being a supply of pressurized fluid connected to the first and second cylinders, and first valve means between the fluid supply and the first cylinder to control the reciproation of the baling head, the improvement comprising:

a pressure switch connected to the fluid supply, the switch being operable to actuate when the pressure of the fluid supply to the first valve means exceeds a predetermined level;

a second valve between the second fluid cylinder and the fluid supply, the second valve being operatively connected to the pressure switch to actuate when the pressure of fluid supply exceeds a predetermined level to retract the tension means, until the pressure of the fluid supply returns below the predetermined level; and a pressure reducing valve between the fluid supply and the second valve so that reduced intermediate supply fluid is supplied to the second fluid cylinder through the second valve.

2. The improvement as defined in claim 1 wherein the pressure switch is adjustable so that the predetermined level at which the switch will actuate may be changed.

3. The improvement as defined in claim 2 wherein the pressure reducing valve is variabled so that the intermediate pressure supplied may be changed.

4. The improvement as defined in claim 1 wherein the valve is a solenoid controlled valve with the solenoid being operatively connected to the pressure switch.

5. The improvement as defined in claim 1 wherein the pressure switch deactuates when the pressure of the fluid supply falls below the predetermined level and wherein the valve between the cylinder and the fluid supply opens when the pressure of the fluid supply falls below the predetermined level so that the supply of pressure returns to the second fluid cylinder which operates the tension means.

6. A baling apparatus comprising:

an enclosure forming a baling chamber with a discharge outlet;

a throat portion adjacent to the discharge outlet of the baling chamber into which compacted bales are forced;

a reciprocal baling head movable within the baling chamber to compact material charged into the chamber against the rear surface of a previously compacted bale;

a first fluid cylinder for reciprocating the baling head;

tension means associated with the throat portion and adapted to hold the previously compacted bale in position in the discharge outlet of the baling chamber until a predetermined force is applied to the bale;

a second fluid cylinder connected to the throat portion for operating the tension means;

a supply of pressurized fluid connected to the first and second cylinders;

first valve means between the fluid supply and the first cylinder to control the reciprocation of the baling head;

a pressure switch connected to the fluid supply, the switch being operable to actuate when the pressure of the fluid supply to the first valve means exceeds a predetermined level;

a solenoid controlled second valve between the second cylinder and the fluid supply, the solenoid being operatively connected to the pressure switch to actuate and retract the tension means when the pressure of the fluid supply exceeds the predetermined level; and a pressure reducing valve between the fluid supply and the second valve to provide reduced intermediate supply fluid to the second fluid cylinder through the second valve.

7. The baling apparatus as defined in claim 6 wherein the pressure switch is adjustable so that the predetermined level at which the switch will actuate may be changed.

8. The baling apparatus as defined in claim 6 wherein the pressure reducing valve is variabled so that the intermediate pressure supplied may be changed.

9. The baling apparatus as defined in claim 6 wherein the valve is a solenoid controlled valve with the solenoid being operatively connected to the pressure switch.

10. The baling apparatus as defined in claim 6 wherein the pressure switch deactuates when the pressure of the fluid supply falls below the predetermined level and wherein the valve between the cylinder and the fluid supply opens when the pressure of the fluid supply falls below the predetermined level so that the supply of pressure returns to the second fluid cylinder which operates the tension means.

* * * * *

UNITED STATES PATENT AND TRADEMARK OFFICE

CERTIFICATE OF CORRECTION

PATENT NO. : 4,565,123

DATED : January 21, 1986

INVENTOR(S) : Gerald W. Sanders

It is certified that error appears in the above-identified patent and that said Letters Patent are hereby corrected as shown below:

Column 9, line 48, change "claim 2" to "claim 1".

Signed and Sealed this

*Sixth* Day of *May 1986*

[SEAL]

*Attest:*

DONALD J. QUIGG

*Attesting Officer*

*Commissioner of Patents and Trademarks*